United States Patent [19]

Nickola

[11] Patent Number: 4,837,091

[45] Date of Patent: Jun. 6, 1989

[54] DIFFUSION ALLOY STEEL FOIL

[75] Inventor: Richard A. Nickola, Munster, Ind.

[73] Assignee: Inland Steel Company, Chicago, Ill.

[21] Appl. No.: 107,908

[22] Filed: Oct. 13, 1987

Related U.S. Application Data

[63] Continuation of Ser. No. 855,331, Apr. 29, 1986, abandoned, which is a continuation-in-part of Ser. No. 733,727, May 14, 1985, abandoned, which is a continuation-in-part of Ser. No. 511,568, Jul. 7, 1983, Pat. No. 4,517,229, and a continuation-in-part of Ser. No. 617,077, Jun. 4, 1984, Pat. No. 4,624,895.

[51] Int. Cl.[4] ..... B32B 15/04; B05D 3/02

[52] U.S. Cl. ..... 428/653; 427/431; 427/367; 427/383.9

[58] Field of Search ..... 428/653; 427/431, 367, 427/383.9

[56] References Cited

U.S. PATENT DOCUMENTS

| | | | |
|---|---|---|---|
| 2,697,869 | 12/1954 | Kingston | 428/653 |
| 3,059,326 | 10/1962 | Jominy | 427/431 |
| 3,305,323 | 2/1967 | Smith . | |
| 3,881,882 | 5/1975 | Hughes | 427/431 |
| 4,279,782 | 7/1981 | Chapman . | |
| 4,686,155 | 8/1987 | Kilbane et al. | 428/653 |

FOREIGN PATENT DOCUMENTS

| | | |
|---|---|---|
| 1391659 | 6/1961 | France . |
| 005332 | 8/1981 | Japan . |

OTHER PUBLICATIONS

R. S. Barnes and D. J. Mazey, "The Effect of Pressure Upon Void Formation in Diffusion Couples," Acta Metallurgica, vol. 6, Jan. 1958, pp. 1–7.

*Primary Examiner*—Sam Silverberg

*Attorney, Agent, or Firm*—Marshall, O'Toole, Gerstein, Murray & Bicknell

[57] ABSTRACT

A cold rolled solid solution iron-aluminum diffusion alloy foil and a method of making the foil are described. The foil has good room temperature formability and high temperature oxidation and corrosion resistance with useful electrical and magnetic properties and is adapted for use as a tool wrap, as an electrical steel, and as a support for a catalyst after a coating of spine-like aluminum oxide whiskers is grown on the surface thereof. The foil is made by hot-dip aluminum coating a titanium stabilized low carbon steel strip, cold rolling the aluminum coated strip to effect between about a 40 and 99 percent reduction in thickness, and diffusion heating the cold rolled aluminum coated steel strip to form a solid solution iron-aluminum diffusion alloy foil containing between about 2 and 12 wt. % aluminum. In a modified form the cold rolled aluminum coated steel is heated in a dry nitrogen containing atmosphere to form an aluminum nitride-containing surface film which has increased resistance to attack by acidic solutions. As a further modification, the foil product is subjected to additional cold rolling to create strain in the foil and the strained foil is heated to cause the crystal size in the foil to be substantially increased.

24 Claims, 3 Drawing Sheets

DIFFUSION ALLOY STEEL FOIL

Figure 1:
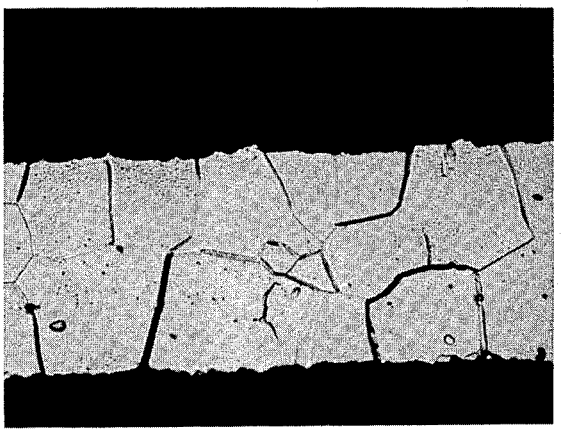

This application is a continuation of application Ser. No. 855,331, filed Apr. 29, 1986 now abandoned which is a continuation-in-part application of U.S. application Ser. No. 733,727, filed May 14, 1985, abandoned, which was a continuation-in-part of the then pending U.S. application Ser. No. 511,568, filed July 7, 1983, now U.S. Pat. No. 4,517,229, and also a cont.-in-part of pending U.S. application Ser. No. 617,077, filed June 4, 1984, now U.S. Pat. No. 4624895.

The present invention relates generally to light gauge steel strips or foils and, more particularly, to very light gauge strips or foils formed of solid solution iron-aluminum diffusion alloys and iron-aluminum-silicon diffusion alloys which are formable at room temperature, have good high temperature oxidation resistance and corrosion resistance, have useful electrical and magnetic properties, and preferably are adapted for growing a surface coating of spine-like whiskers of aluminum oxide suitable for retaining a surface coating of a catalytic metal used in a monolithic catalytic converter for treating gases which pollute the atmosphere.

Heretofore, an iron-aluminum diffusion alloy foil has not been available. The Smith et al U.S. Pat. No. 3,214,820 discloses steel foils having a surface coated with tin, zinc, aluminum or stainless steel and describes producing the steel foil with the metallic tin, zinc, aluminum or stainless steel protective metal coating by cold rolling a plain carbon steel strip having the protective metal coating applied by a plating process. Smith et al teaches against hot dip coating a steel strip for cold rolling to foil gauge in order to avoid forming a hard brittle subsurface intermetallic layer which Smith et al states prevents forming a satisfactory foil product. The Smith et al patent expressly avoids annealing a steel strip coated with tin, zinc, or aluminum, because of the low melting temperatures of these coatings.

The Kingston et al U.S. Pat. No. 2,697,869 discloses a formable steel strip having an ultra thin iron-aluminum diffusion alloy surface coating formed as a result of annealing after cold rolling a steel strip between 35 to 50% to provide an ultra thin aluminum surface coating which has a critical maximum thickness of 0.0003 inch. When the cold rolled strip is annealed to impart good formability to the work hardened strip, an ultra thin iron-aluminum alloy surface coating is formed without an objectionable amount of brittle subsurface intermetallic alloy layer being formed.

The Yagi et al U.S. Pat. No. 4,228,203 discloses producing an iron-aluminum diffusion alloy coated steel sheet in which a powder aluminum coating is applied to a carbon steel strip and the powder coated strip is diffusion heated to form a thin iron-aluminum diffusion alloy surface coating on the steel strip. The diffusion heating in Yagi et al forms a brittle subsurface iron-aluminum intermetallic compound layer below the diffusion alloy surface coating which results in the strip having poor formability at room temperature, and Yagi et al does not reduce the diffusion coated strip to foil gauge.

The French Pat. No. 1,391,659 discloses providing titanium-containing iron-aluminum diffusion alloy strips which have poor room temperature formability and which are produced by a process comprising cold rolling a titanium containing steel strip to approximately its desired final thickness, immersing the strip in an aluminum coating bath to form a thick aluminum coating which provides between 8 and 30 wt. % aluminum on the strip, and subjecting the aluminum coated strip to diffusion heating to diffuse the aluminum uniformly throughout the strip. The iron-aluminum diffusion alloy strips have such poor formability at room temperature that they must be rolled hot in order to effect reduction in thickness by rolling.

It is therefore an object of the present invention to provide a method of producing economically a solid solution iron-aluminum diffusion alloy foil which is formable at room temperature and resistant to oxidation at elevated temperatures.

A further object of the present invention is to provide an economical room temperature formable solid solution iron-aluminum diffusion alloy foil which is useful as a tool wrap.

Still another object of the present invention is to provide a solid solution iron-aluminum diffusion alloy foil which exhibits improved electrical properties.

It is also an object of the present invention to provide in an economical manner a cold reduced stabilized solid solution iron-aluminum diffusion alloy foil which is formable at room temperature and which has an adherent surface coating of spine-like whiskers of aluminum oxide.

A still further object of the present invention is to provide a solid solution iron-aluminum diffusion alloy foil by cold rolling and diffusion heating an aluminum coated steel strip which is characterized by good resistance to oxidation and corrosion at room temperature and at elevated temperatures, as when exposed to exhaust gases from automotive and industrial apparatus.

Figure 2:
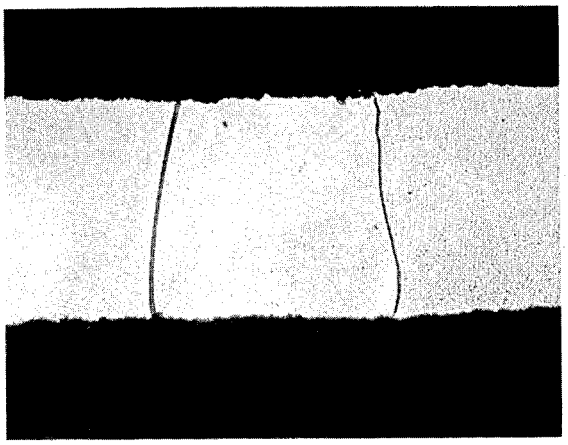
Figure 3:
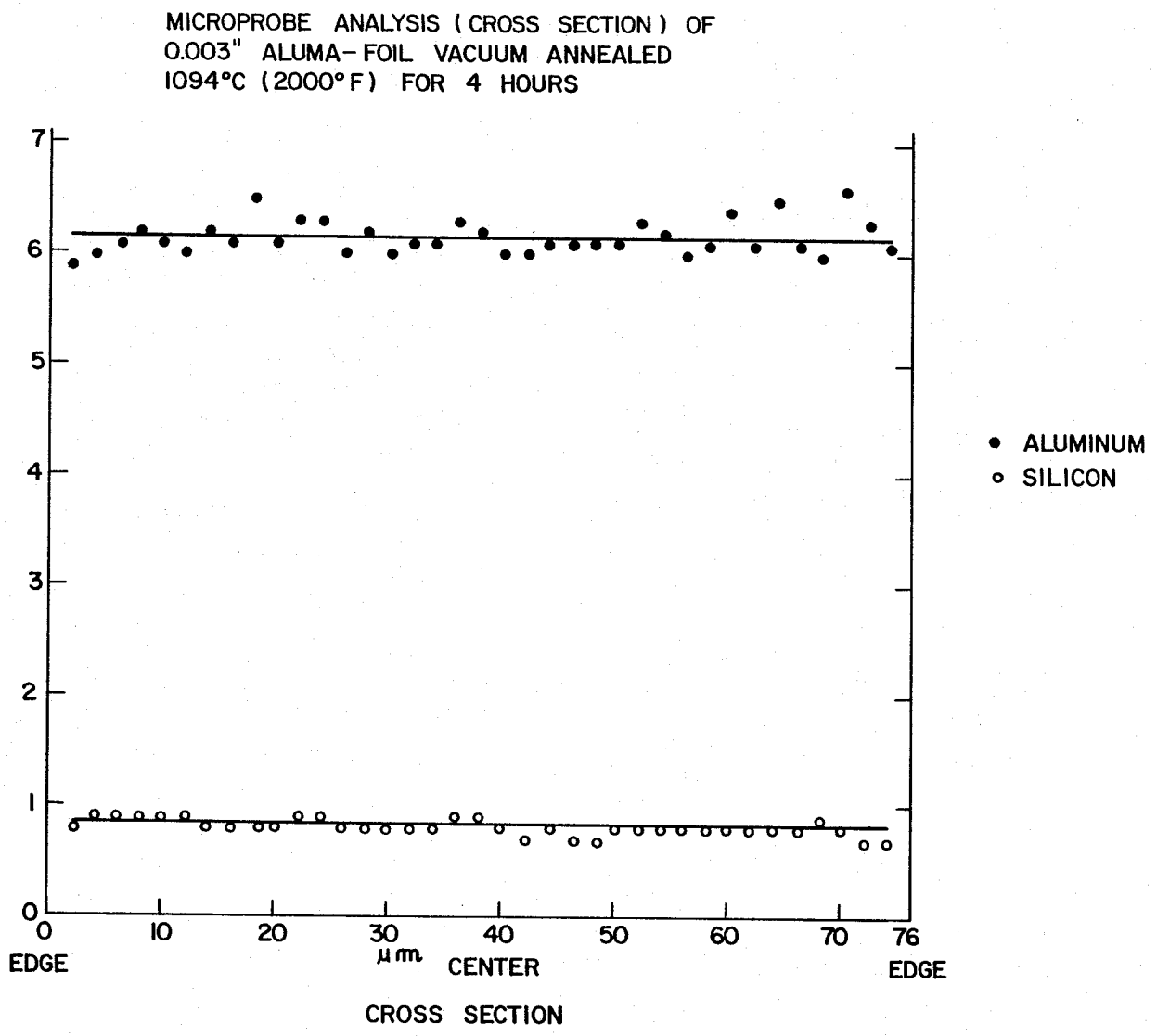
Figure 4:
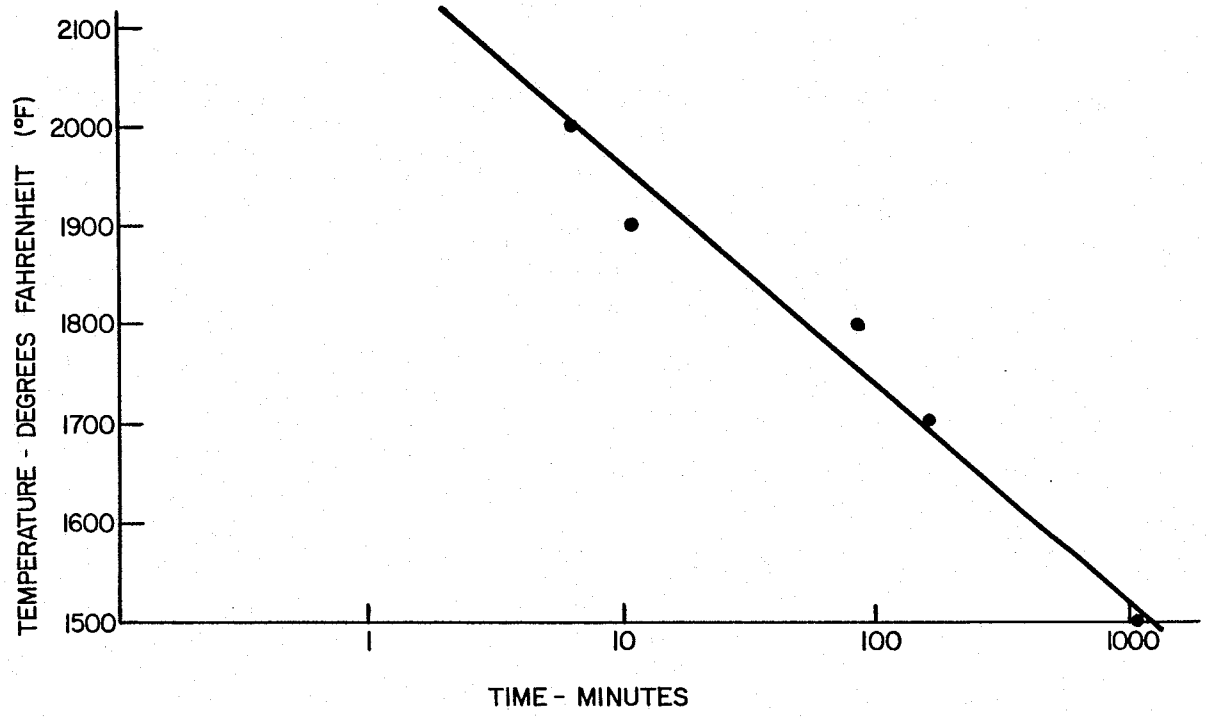

Other objects of the present invention will be apparent to those skilled in the art from the detailed description and claims to follow when read in conjunction with the accompanying drawing wherein:

FIG. 1 is a photomicrograph at 500× magnification of a cross section of 0.076 mm (0.003 inch) thick electrolytically etched solid solution iron-aluminum-silicon diffusion alloy foil containing 6.2 wt. % aluminum, 0.86 wt. % silicon and 0.41 wt. % titanium formed by cold rolling a hot-dip Type I aluminum coated low-titanium alloy stabilized low-carbon steel strip about 0.47 mm (0.0185 inch) thick and reduced 84 percent on a Sendzimir cold rolling mill and thereafter vacuum diffusion heated for 4 hours at 982° C. (1800° F.);

FIG. 2 is a photomicrograph at 500× magnification of the diffusion alloy foil material of FIG. 1 which has been diffusion heated at 1094° C. (2000° F.) for four hours and showing the foil having large oriented crystal with the foil being one grain thick;

FIG. 3 is a graph showing the substantially uniform distribution of aluminum along the cross-section of the solid solution diffusion alloy foil of FIG. 2, as determined by microprobe analysis; and FIG. 4 is a graph showing the diffusion heating time required to substantially uniformly diffuse the aluminum throughout the interior of a 0.0033 inch thick aluminum coated low titanium alloy carbon steel foil at temperature between 816° C. (1500° F.) and 1149° C. (2100° F.).

A foil formed substantially of an iron-aluminum or iron-aluminum-silicon diffusion alloy is produced in accordance with a preferred embodiment of the invention by forming on each side of a cold rolled titanium stabilized low-carbon steel strip, preferably having a thickness between about 0.25 mm (0.010 inch) and about 0.76 mm (0.030 inch), a hot-dip aluminum coating using conventional continuous in-line hot-dip aluminum coating apparatus with the aluminum or aluminum-silicon hot-dip coating on each side of the strip having a thickness of between about 12.7 um (0.0005 inch) and about 76 um (0.003 inch) which is sufficient to provide after diffusion heating a diffusion alloy foil containing between about 2 wt. % aluminum and about 12 wt. % aluminum, cold reducing the hot-dip aluminum coated titanium alloy steel strip to effect at least about a 40 percent and up to about a 99 percent reduction in the thickness of the aluminum coated steel strip to provide an aluminum coated light gauge steel strip or steel foil preferably having a maximum thickness of about 0.152 mm (0.006 inch) and as thin as about 0.013 mm (0.0005 inch) with the cold rolled aluminum coating having a thickness ranging between about 1.07 um (0.000042 inch) and 27.9 um (0.0011 inch) and diffusion heating the cold reduced aluminum coated steel foil to diffuse the aluminum into the steel and form a formable solid solution iron-aluminum diffusion alloy foil containing from about 2 wt. % aluminum and up to about 12 wt. % aluminum. The diffusion of the aluminum throughout the cross section of an aluminum coated titanium alloy steel foil is time-temperature dependent for a given aluminum coating and foil thickness and can be effected at a temperature preferably between about 816° C. (1500° F.) and 1149° C. (2100° F.) for between about 2 minutes and about 24 hours when using box annealing apparatus. Although, it is not essential to diffuse the aluminum uniformly through the steel base, the graph in FIG. 4 shows the time required to diffuse the aluminum uniformly throughout the cross section of a hot-dip coated low titanium alloy steel foil 0.084 mm (0.0033 inch) thick having an aluminum coating 8.9 μm (0.00035 inch) thick on each surface when diffusion heating at temperatures between 816° C. (1500° F.) and 1149° C. (2100° F.).

In order to provide a low cost foil formed of a solid solution iron-aluminum diffusion alloy which is formable at room temperatures with good high temperature oxidation resistance and good electrical properties and which is also capable of growing a surface coating of aluminum oxide whiskers suitable for supporting a catalytic coating, it has been found advisable to form the steel strip from a stabilized low carbon steel such as a low-titanium stabilized low-carbon steel. The low-titanium stabilized alloy steel is preferably a steel which has been killed to remove free oxygen, such as an aluminum killed steel. The carbon content of the low-titanium alloy steel is less than 0.10 wt. %, generally between about 0.02 wt. % and 0.10 wt. %, although a vacuum degassed steel having substantially less than 0.02 wt. % carbon can also be used. The low-titanium stabilized low carbon steel should have sufficient titanium to combine with all the carbon, oxygen, and nitrogen in the steel and, in addition, sufficient titanium to provide a small excess of uncombined titanium, preferably at least about 0.02 wt. %. The total titanium content of the steel is preferably at least about 0.40 wt. % but will always be less than about 1.0 wt. % and will generally not exceed about 0.60 wt. %. The titanium in the stabilized steel improves the rate of diffusion between the iron and aluminum in the steel and also improves the surface properties and increases the strength of the steel, thereby improving the cold rolling properties and room temperature ductility properties of the steel strip. If desired, smaller amounts of other carbon and nitrogen binders can be used in addition to the titanium in the steel.

A typical low-titanium stabilized low-carbon steel suitable for forming an aluminum coated steel foil in accordance with the present invention has the following composition on a weight basis: 0.04% carbon, 0.50% titanium, 0.20–0.50% manganese, 0.012% sulfur, 0.010% phosphorus, 0.05% silicon, 0.020–0.090% aluminum, and the balance essentially iron with incidental impurities.

In producing a commercially acceptable low cost solid solution iron-aluminum diffusion alloy foil by cold rolling a hot-dip aluminum coated low-titanium alloy stabilized steel strip which is heated to form the diffusion alloy foil, the thickness of the steel strip relative to the aluminum coating thereon must be carefully controlled in order to provide the required amount of aluminum in the diffusion alloy. Also, in order to hot-dip aluminum coat a steel strip on production-type in-line continuous aluminum coating apparatus, it is essential that the steel strip be sufficiently thick to withstand the stresses of being conveyed through the continuous hot-dip coating apparatus, such as a Sendzimir-type hot-dip continuous coating line, but not so thick as to make it impossible to reduce economically the coated strip to a steel foil gauge not substantially above about 0.152 mm (0.006 inch) by effecting about a 40 to 99 percent reduction in the thickness of the hot-dip coated aluminum steel strip.

A further important limitation on the maximum thickness of the steel strip to be hot-dip coated on a continuous coating line, such as Sendzimir-type hot-dip coating line, is the requirement that the temperature of the strip, after cleaning and surface preparation, must be adjusted to a temperature about the temperature of the aluminum hot-dip coating bath before the strip is immersed in the aluminum coating bath and while the strip is traveling at a sufficiently high line speed to form (i.e. pick up) a hot-dip aluminum coating having a coating thickness which will provide after diffusion heating an aluminum content sufficient to impart the desired oxidation resistance to the coated steel foil.

A steel strip having a thickness of between about 0.25 mm (0.010 inch) and 0.76 mm (0.030 inch) has been found to meet the foregoing requirements and be suitable for hot-dip aluminum coating on a continuous in-line hot-dip aluminum coating apparatus, such as a Sendzimir-type commercial continuous hot-dip coating line, adapted to move the steel strip at a line speed of about 280 feet per minute, the strip thereafter being cold reduced to effect between about 40 to 99 percent reduction in thickness so as to provide an aluminum coated steel foil having a thickness of between about 0.013 mm (0.0005 inch) and about 0.152 mm (0.006 inch). The aluminum hot-dip coated steel strip can be cold reduced to foil gauge in one or more passes through a cold rolling mill, such as a Sendzimir cold rolling mill.

Where the surface of the foil is not perfectly flat but has surface irregularities formed in the diffusion alloy foil after diffusion heating, the foil material can be further processed by tension leveling or skin passing to remove distortions in the foil and/or effect surface brightening and polishing.

It has also been found that in order for the solid solution iron-aluminum diffusion alloy foil to provide good high temperature oxidation resistance over an extended period and exhibit good room temperature formability, as required for fabricating into an automotive exhaust system or for use as a tool wrap, the aluminum hot-dip coating on the steel strip must be sufficiently thick relative to the thickness of the steel strip to provide in the finished foil a minimum of about 6 wt. percent aluminum based on the weight of the coated foil and not substantially above about 12 wt. % aluminum where room temperature formability is required. In the very thinnest foil, however, a somewhat higher aluminum content may be used without impairing room temperature formability. Since the steel strip and the hot-dip aluminum coating are reduced in substantially the same proportion when cold rolled to effect about a 90% reduction in the thickness of the coated strip, a steel strip having a thickness before hot-dip coating of between about 0.25 mm (0.010 inch) and about 0.76 mm (0.030 inch) should be provided on each side with an aluminum hot-dip coating having a thickness of between about 12.7 μm (0.0005 inch) and about 76 μm (0.003 inch) but sufficient to provide the strip with between about 6 wt. % and about 12 wt. % aluminum. For example, after about a 90% cold reduction in thickness of a hot-dip aluminum coated steel strip having an initial thickness of about 0.51 mm (0.020 inch), the cold rolled aluminum coating on each side of the foil is about 5.1 μm (0.0002 inch) thick and provides an aluminum concentration of about 6 wt. % based on the weight of the aluminum coated steel foil.

The hot-dip aluminum coating applied to the steel strip is preferably a Type I aluminum coating which contains aluminum with about 5–12 wt. % silicon and wherein the silicon prevents the formation of an objectionably thick subsurface iron-aluminum intermetallic layer. When the steel strip is hot-dip coated in a Type I aluminum coating bath containing 1012 wt. percent silicon, the diffusion alloy foil contains about 0.7 wt. percent silicon. It is also possible, though not preferred, to apply a Type II aluminum (i.e. substantially pure aluminum) hot-dip coating on the stabilized low carbon steel strip.

In order to transform a steel foil having metallic aluminum surface coatings into a diffusion alloy foil having an iron-aluminum diffusion alloy composition substantially throughout, the aluminumcoated steel foil is heated as an open or closed coil in an annealing furnace or on a continuous annealing line in a non-oxidizing atmosphere, which may be nitrogen-free such as in a vacuum or in an argon atmosphere, at 982° C. (1800° F.) for between about 1 and 24 hours. The time required to form the iron-aluminum diffusion alloy will depend on the thickness of the steel strip and aluminum coating as well as the temperature of heating.

When producing an iron-aluminum or iron-aluminum-silicon diffusion alloy foil for use as an electrical steel, it is important that the aluminum or aluminum-silicon coating be substantially uniformly diffused throughout the cross-section of the foil. For other foil applications, however, it is not essential to have the aluminum or aluminum-silicon coating diffused uniformly throughout the cross-section of the foil.

As an example of forming a solid solution iron-aluminum diffusion alloy foil according to the present invention, a low-titanium alloy stabilized low-carbon aluminum killed steel was formed into a steel strip having a thickness of about 0.43 mm (0.017 inch). The titanium stabilized low-carbon aluminum killed steel had the following approximate composition:

| | Wt. Percent |
|---|---|
| Carbon | 0.04 |
| Manganese | 0.25 |
| Phosphorus | 0.009 |
| Sulfur | 0.012 |
| Silicon | 0.06 |
| Molybdenum | 0.005 |
| Aluminum | 0.060 |
| Titanium | 0.50 |
| Total residual of Cu, Ni, Sn, Cr | 0.20 |
| Iron | Balance |

The titanium stabilized steel strip after conventional cleaning was immersed in a hot-dip Type I aluminum coating bath having a temperature of 694° C. (1280° F.) on a Sendzimir-type continuous coating line having a line speed of 280 feet per minute to provide both sides thereof with a hot-dip aluminum coating having a thickness of about 38 μm (0.0015 inch). The hot-dip aluminum coated steel strip was cold rolled on a Sendzimir-type cold rolling mill to a foil thickness of about 0.051 mm (0.002 inch) in four passes, effecting a reduction of 43.6% in the first, 45.5% in the second, 45.0% in the third, and 39.4% in the fourth, for a total of about 90% reduction in thickness without intermediate annealing. Metallographic examination of the cold reduced steel foil indicated a uniform aluminum surface coating on both sides, approximately 4.6–5.1 μm (0.00018–0.0002 inch) with the intermetallic subsurface iron-aluminum compound layer completely fractured and randomly redistributed throughout the aluminum coating and with the cold working of the coated steel strip imparting a very high energy level to the coated steel so that during the subsequent diffusion heating treatment there are no Kirkendall voids formed in the diffusion alloy product. The aluminum in the coating is preferably fully and substantially uniformly diffused throughout the cross section of the foil by heating the foil for two hours at a temperature of 982° C. (1800° F.) to form an iron-aluminum-silicon diffusion alloy foil. Bulk chemical analyses of the hot-dip aluminum coated foil after diffusion showed 6.4 wt. % aluminum, 0.8 wt. % silicon, and 0.40 wt. % titanium.

The solid solution iron-aluminum diffusion alloy foil made in the foregoing manner was free of brittle iron-aluminum intermetallic compound and was formable at room temperature without annealing. When heated in air at 1149° C. (2100° F.) for 96 hours the foil material exhibited a weight gain of no more than 1 mg/cm$^2$, had good high temperature corrosion and oxidation resistance at 1000° C. (1832° F.), and when given a 180% 1-T bend at room temperature the surface was not ruptured. The iron-aluminum diffusion alloy foil had a tensile strength of 72 ksi, a yield strength of 65 ksi, and an elongation of 10.4%.

The cold reduced aluminum-coated steel foil of FIG. 1 having about 6 wt. % of the foil as aluminum in the surface coatings was diffusion heated as a closely wound steel coil in a vacuum at 1093° C. (2000° F.) for four hours to provide a foil having the aluminum substantially fully diffused throughout the cross section of the foil. The distribution of the aluminum and silicon in the iron-aluminum diffusion alloy steel foil is shown in FIG. 3.

The extreme outer 2.5 μm (0.0001 inch) to 5.0 um (0.0002 inch) of the surface of the diffusion alloy foil of the present invention has been found to contain a higher than average concentration of titanium and aluminum, and it is evident that uncombined titanium in the titanium stabilized steel has diffused outwardly from the interior to the surface of the foil. The concentration of titanium in the surface becomes progressively larger and the concentration of titanium in the center of the foil becomes progressively smaller as the diffusion heating is prolonged until no titanium remains at the center of the foil. For example, after a foil 0.05 mm (0.002 inch) thick is diffusion heated in nitrogen at 925° C. (1700° F.) for 24 hours, there is no detectable titanium remaining at the center of the foil when the foil is subjected to electron microprobe analysis.

The relatively low cost iron-aluminum and iron-aluminum-silicon diffusion alloy foils of the present invention are useful in place of the more costly stainless steel foils and high alloy foils for many industrial applications. Thus, the cold rolled iron-aluminum diffusion alloy steel foils produced as described herein are useful as a substitute for "321 stainless steel" foil and for enclosing or "wrapping" tools which are heat treated at an elevated temperature, thereby avoiding the need to heat the tools in a protective non-oxidizing atmosphere. The diffusion alloy tool wrapping foils preferably contain between about 6 wt. % and 12 wt. % aluminum and have a thickness between about 0.050 mm (0.002 inch) and 0.075 mm (0.003 inch) so as to have the required high temperature strength and oxidation resistance as well as formability at room temperature to form a protective wrap for enclosing tools and withstanding heat treating temperatures up to about 1149° C. (2100° F.). The aluminum content of the foil also acts as a "getter" to remove oxygen from within the enclosure and prevents objectionable oxidation and decarburization of the surface of the tools during the heat treating cycle.

The solid solution iron-aluminum and iron-aluminum-silicon diffusion alloy foils of the present invention when prepared by vacuum diffusion heating with between 2 and 12 wt. percent aluminum and which can also contain between about 0.2 and about 0.9 wt. % silicon are useful as electrical steels of the electrically soft variety for use as magnetic shielding material and for making core assemblies of electrical rotary equipment (i.e. motors) and transformers in place of silicon steels, iron-nickel alloys and other ferrous alloys. Aluminum has a beneficial effect, similar to that of silicon, on the electrical resistivity and certain magnetic properties of iron, but aluminum is seldom substituted for silicon because of the recognized difficulty of fabricating thin iron-aluminum alloy sheet material. At present aluminum is used most commonly at a concentration of less than 0.05 wt. % in non-oriented silicon steels. While it is recognized that ternary alloys of iron, silicon and aluminum have high resistivity and good permeability at low flux densities, that the magnetic properties of these ternary alloys can approach those of more costly iron-nickel alloys, and that increasing the concentration of silicon and aluminum reduces saturation induction, nevertheless, silicon and aluminum have not been used in electrical steels in excess of about 4 wt. % because such steels are brittle and are very difficult to roll into thin gauge sheet material. With the present invention, however, it is possible to provide a workable electrical iron-aluminum or iron-aluminum-silicon thin gauge diffusion alloy strip or foil having in excess of 4 wt. % aluminum with large grain size and desirable crystal orientation which closely approximates the ideal electrical steel material. For example, one type of electrical steel foil should preferably be one grain thick with the grain (crystal) faces parallel to the direction of rolling (see FIG. 2). An iron-aluminum-silicon diffusion alloy containing about 6 wt. % aluminum and 0.9 wt. % silicon has an electrical resistance of about 91–96 microohm centimeters. If desired, the diffusion alloy foil where intended for certain types of electrical use can be further treated after diffusion heating by cold rolling to reduce the thickness of the foil and impart critical strain to the foil product and then given a critical time-temperature heat treatment to modify the crystal form. For example, an iron-aluminum-silicon diffusion alloy foil of the present invention has been cold rolled to impart a 3% critical strain and heated at 816° C. (1500° F.) for 4 hours to effect a very large increase in the grain size.

Where the iron-aluminum diffusion alloy foil is used as a support for a metal catalyst in a catalytic converter, the foil, preferably having a thickness about 0.051 mm (0.002 inches) and containing about 6 wt. percent aluminum, can be preconditioned for whisker growth by the method disclosed in U.S. Pat. No. 4,279,782. Thereafter, the foil is heated in air oxygen containing atmosphere or other preferably for 8 hours at 925° C. (1700° F.), to grow aluminum oxide an spine-like whisker surface coating. A coating of gamma aluminum oxide powder dispersed in an aqueous alumina gel-noble metal catalyst mixture is applied to the spine-like whisker coated surface of the foil as described in U.S. Pat. No. 4,279,782.

In order to impart optimum corrosion resistance to a solid solution iron-aluminum diffusion alloy foil the cold rolled aluminum coated low-titanium stabilized low carbon steel foil is placed in a dry nitrogen-containing atmosphere which has minimal or no oxidizing action on the titanium and aluminum in the foil and is heated for a time and at a temperature sufficient to form on the surface of the diffusion alloy foil a thin titanium nitride-containing film which imparts high corrosion resistance to the foil. As previously discussed, when an aluminum coated titanium stabilized low carbon steel foil having a slight excess of uncombined titanium is heated in a non-oxidizing atmosphere, the aluminum surface coating diffuses readily into the steel foil beginning at a temperature of about 399° C. (750° F.) and effects formation of an iron-aluminum diffusion alloy foil. When the titanium stabilized aluminum coated steel foil is diffusion heated in a dry nitrogen-containing atmosphere, which has a minimal oxidizing effect on the titanium and aluminum, at a temperature between about 500° C. (930° F.) and 1093° C. (2000° F.) and preferably at a temperature of about 925° C. (1700° F.), the nitrogen reacts with the titanium to form a titanium nitride-containing film on the surface of the diffusion alloy foil.

The titanium nitride-containing layer on the surface of the foil significantly improves the corrosion resistance of the iron-aluminum diffusion alloy foil, since the titanium nitride-containing surface film is resistant to attach by acids, and resists corrosion when the foil is immersed in an aqueous acidic solution for prolonged periods. Titanium nitride is only slightly soluble in hot aqua regia containing added hydrofluoric acid. Aluminum nitride on the other hand, is readily attacked by acids, such as a hot 10% aqueous hydrochloric acid solution, whereas the foil having the titanium nitride-containing surface film is resistant to attack by the 10% hydrochloric acid solution. The titanium nitride can be present as TiN which has a sigma crystal form or as $Ti_2N$ which has a gamma crystal form. it is also possible for the titanium and nitrogen to form more complex reaction products with the aluminum, iron and silicon in the steel.

The dry nitrogen-containing atmosphere used to form the titanium nitride-containing film can be pure nitrogen gas, gaseous ammonia, dissociated ammonia, a nitrogen-hydrogen gaseous mixture, or a nitrogen-argon gaseous mixture. The diffusion heat treatment with the dry nitrogen-containing atmosphere can range from about 500° C. (930° F.) to about 1093° C. (2000° F.) for a period of from about 0.25 to about 48 hours with the formation of the titanium nitride-containing film being time-temperature dependent. When a 2 mil thick aluminum coated low-titanium alloy steel foil is heated at 925° C. (1700° F.) in a dry 95% nitrogen-5% hydrogen atmosphere, a very thin titanium nitride-containing film begins to form on the surface of the steel after heating for 8 minutes and increases in thickness as heating continues. After the alloy steel foil is heated for 15 minutes at 925° C. (1700° F.), the titanium nitridecontaining film on the surface of the foil is sufficiently thick that it is not etched when washed for 2 minutes with 10% hydrochloric acid aqueous solution at a temperature of 66° C.–82° C. (150° F.–180° F.).

Electron microprobe x-ray analysis data and xray maps at 4000X magnification of a solid solution iron-aluminum diffusion alloy foil made by diffusion heating an aluminum coated low titanium stabilized steel in a pure nitrogen atmosphere for 24 hours at 925° C. (1700° F.) and having as a bulk analysis 6.8% aluminum, 0.34% titanium, 0.05% carbon, 0.35% nitrogen, 0.85% silicon and the balance iron with incidental impurities, indicate the presence of a titanium nitride-containing film or layer having a mean thickness of about 0.23 mils on the surface of the foil. The surface film has a peak concentration of 12.6 wt. percent titanium and very little titanium is present in the interior of the foil except at isolated points which are thought to indicate the presence of titanium carbide.

The nitrogen treated foil having the titanium nitride-containing film on the surface exhibits good room temperature formability when a section of the nitrogen treated foil having a thickness of 3.3 mils is subjected to the Zero-T Bend Test and can be cold rolled with conventional apparatus. The nitrogen treated diffusion alloy foil has a tensile strength of about 82 ksi, a yield strength of about 81 ksi, and an elongation of about 1.0 percent. The emittance of the nitrogen treated diffusion alloy foil is between 0.8–0.9 (black body=1.0).

Aluminum oxide whiskers do not readily grow on the diffusion alloy foil having a titanium nitridecontaining surface. Consequently, when the iron-aluminum diffusion alloy low titanium stabilized foil must have a thick surface growth of spine-like whiskers of aluminum oxide, as when the foil is used to support a catalyst in an automotive catalytic converter, and where optimum corrosion resistance and/or good abrasion resistance is also desired, the thick coating of spine-like whiskers is grown on the surface of an aluminum coated steel foil by the process described in U.S. Pat. No. 4,279,782 before heating in a dry nitrogen-containing atmosphere. Thereafter the whisker coated foil can be heated in a dry nitrogen-containing atmosphere for a time and at a temperature sufficient to form a titanium nitride-containing thin layer or film on the surface of the iron-aluminum diffusion alloy steel. For example, the whisker coated foil can be heated for a period of between about 0.25 hours and 24 hours at a temperature between about 1093° C. (2000° F.) and 500° C. (930° F.), respectively, in a dry nitrogen-containing atmosphere, such as in an atmosphere of gaseous nitrogen or ammonia, to form a titanium nitride-containing layer on the surface of the foil. The titanium nitride-containing layer imparts high corrosion resistance and abrasion resistance to the whisker coated diffusion alloy foil.

Whereas in applicant's preferred embodiment the iron-aluminum diffusion alloy foil is produced by cold rolling a hot-dip aluminum coated titanium stabilized steel strip to foil gauge followed by diffusion heating, it is also within the scope of the present invention to apply the aluminum or aluminumsilicon coating to the titanium stabilized steel strip by other known aluminum coating processes, such as a powder metal coating process in accordance with U.S. Pat. No. 4,542,048, or by electroplating.

The term "formable" as used herein designates the capability of the foil to be fabricated by conventional metal forming machines at room temperature, and the term "good formability" as used herein refers to the capability of the foil to undergo severe deformation at room temperature without bend breaking, edge cracking and loss of surface material.

The term "solid solution iron-aluminum diffusion alloy" is used herein to designate an iron-aluminum diffusion alloy or an iron-aluminum-silicon diffusion alloy, such as formed by diffusion heating a Type I aluminum hot-dip coating containing about 5 to 12 wt. % silicon, although higher and lower amounts of silicon can be used for producing special diffusion alloy foils.

I claim:

1. A solid solution iron-aluminum diffusion alloy foil in essentially unformed and unfabricated state , said foil being obtained in situ by providing a titanium stabilized low carbon steel strip containing an excess of uncombined titanium , providing an aluminum coating on each side of said strip, cold reducing the coated steel strip to foil gauge, and thereafter diffusion heating the foil gauge strip, the coated steel strip before cold reduction having a steel strip thickness selected from the range of from about 0.25 mm (0.010 inch) to about 0.76 inch (0.030 inch) with the aluminum coating on each side of said steel strip having a thickness selected from the range of from about 12.7 μm (0.0005 inch) to about 76 μm (0.003 inch), the coated steel strip after cold reduction of from about 40% to about 99% and before diffusion heating having a foil thickness of from about 0.013 mm (0.0005 inch) to about 0.152 mm (0.006 inch) with the aluminum coating on each side thereof having a thickness of from about 1.07 μm (0.000042 inch) to about 27.9 μm (0.0011 inch), and the thickness of the steel strip relative to the thickness of the aluminum coatings before cold reduction being controlled, within the aforementioned ranges, so as to provide in said solid solution iron-aluminum diffusion alloy foil an aluminum content in excess of about 4 wt. % and not substantially above about 12 wt. % with the aluminum fully diffused throughout the cross section of the foil, said foil being formable at room temperature and being resistant to oxidation and to corrosion at elevated temperatures.

2. An iron-aluminum diffusion alloy foil as in claim 1, wherein said titanium stabilized low-carbon steel has all the carbon and nitrogen in the steel chemically combined with titanium and has an excess of at least about 0.02 wt. % uncombined titanium.

3. An iron-aluminum diffusion alloy foil as in claim 1, wherein said titanium stabilized low carbon steel has a carbon content of less than 0.10 wt. % carbon and a titanium content of at least about 0.40 wt. % but less than about 1.0 wt. %.

4. An iron-aluminum diffusion alloy foil as in claim 1, wherein said stabilized low-carbon steel is a low-titanium alloy aluminum killed steel.

5. An iron-aluminum diffusion alloy foil as in claim 1, wherein the diffusion alloy contains between about 0.2 wt. % and about 0.9 wt. % silicon.

6. An iron-aluminum diffusion alloy foil as in claim 1, wherein said foil has on the surface of said diffusion alloy steel a titanium nitride-containing film.

7. An iron-aluminum diffusion alloy foil as in claim 1, wherein said foil has a surface coating of spine-like whiskers of aluminum oxide.

8. An iron-aluminum diffusion alloy foil as in claim 7, wherein said foil has formed on the whisker coated surface a titanium nitride-containing film.

9. An iron-aluminum diffusion alloy foil as in claim 1, wherein a growth of spine-like whiskers of aluminum oxide on the surface of said foil is adapted to support a coating of a catalyst useful for treating exhaust gases from automotive or industrial apparatus which produce atmosphere pollutants.

10. An iron-aluminum diffusion alloy foil as in claim 1, wherein said foil has an aluminum content of between about 6 wt. % and about 12 wt. %.

11. An iron-aluminum diffusion alloy foil as in claim 1, wherein said foil has the aluminum substantially uniformly diffused throughout the cross section of said foil and has a large grain size with a thickness of one grain and with the grain faces parallel to the direction of rolling of said foil.

12. An iron-aluminum diffusion alloy foil as in claim 2, wherein said foil has a higher concentration of titanium at the surface thereof than in the interior thereof.

13. An iron-aluminum diffusion alloy foil as in claim 12, wherein said diffusion alloy foil has a titanium nitride-containing film on the surface thereof.

14. A method of producing a room temperature formable solid solution iron-aluminum diffusion alloy foil that is resistant to oxidation and to corrosion at elevated temperatures, comprising:

forming a strip of titanium stabilized low carbon steel containing an excess of uncombined titanium and having a thickness selected from the range of from about 0.25 mm (0.010 inch) to about 0.76 mm (0.030 inch);

applying to each surface of said steel strip an aluminum coating having a thickness selected from the range of from about 12.7 μm (0.0005 inch) to about 76 μm (0.003 inch);

reducing the thickness of the aluminum coated strip between about 40% and about 99% by cold rolling to form an aluminum coated foil having a thickness of from about 0.013 mm (0.0005 inch) to about 0.152 mm (0.006 inch) with the aluminum coating on each side thereof having a thickness of from about 1.07 μm (0.000042 inch) to about 27.9 μm (0.0011 inch);

heating said cold rolled aluminum coated foil to form a solid solution iron-aluminum diffusion alloy foil with the aluminum fully diffused throughout the cross section of the foil; and controlling the thickness of the steel strip relative to the thickness of the aluminum coatings before cold rolling, within the aforementioned ranges, so as to provide in said solid solution iron-aluminum diffusion alloy foil an aluminum content in excess of about 4 wt. % and not substantially above about 12 wt. %.

15. A method as in claim 14, wherein said heating of the aluminum coated steel foil is effected in a nitrogen-free non-oxidizing atmosphere.

16. A method as in claim 14, wherein said heating of the aluminum coated steel foil is effected in a dry nitrogen-containing atmosphere having minimal or no oxidizing action on titanium and aluminum in said foil for a time and at a temperature which forms a titanium nitride-containing film on the surface of the iron-aluminum diffusion alloy steel.

17. A method as in claim 14, wherein the said aluminum coating on said titanium stabilized low-carbon steel strip is provided by hot-dip aluminum coating said strip.

18. A method as in claim 14, wherein said titanium stabilized low-carbon steel has all the carbon and nitrogen in the steel chemically combined with titanium and having in the steel an excess of at least about 0.02 wt. % uncombined titanium.

19. A method as in claim 14, wherein said titanium stabilized low carbon steel has a carbon content of less than 0.10 wt. % carbon and a titanium content at least about 0.40 wt. % but less than about 1.0 wt. %.

20. A method as in claim 14, wherein said titanium stabilized low-carbon steel has a carbon content of about 0.04 wt. % and a titanium content of about 0.50 wt. %.

21. A method as in claim 14, wherein said diffusion alloy foil has a silicon content between about 0.2 wt. % and about 0.9 wt. %.

22. A method as in claim 14, wherein said diffusion alloy foil is heated in an oxygen containing atmosphere for a time and at a temperature which forms a growth of aluminum oxide spine-like whiskers on the surface of said foil.

23. A method as in claim 22, wherein said foil having a growth of said whiskers on the surface of said foil is heated in a dry nitrogen-containing atmosphere which has minimal or no oxidizing action on titanium and aluminum for a time and at a temperature which forms a titanium nitride-containing film on the whisker coated surface 24. A method as in claim 14, wherein said diffusion alloy steel foil is cold rolled after diffusion heating to impart critical strain to said foil and thereafter subjecting said foil to heating to increase crystal size in said foil.

* * * * *